US006358444B1

(12) United States Patent
Ishikawa et al.

(10) Patent No.: US 6,358,444 B1
(45) Date of Patent: Mar. 19, 2002

(54) METHOD OF PREVENTING WARP OF A SKID PANEL

(75) Inventors: Takashi Ishikawa; Toru Morita, both of Minato-ku (JP)

(73) Assignees: Nippon High Strength Concrete Co., Ltd.; The Nippon Road Co., Ltd., both of Tokyo (JP)

( * ) Notice: Subject to any disclaimer, the term of this patent is extended or adjusted under 35 U.S.C. 154(b) by 0 days.

(21) Appl. No.: 09/421,406

(22) Filed: Oct. 21, 1999

(51) Int. Cl.[7] ..... B28B 1/14; B28B 7/02; B28B 7/22; B28B 23/00

(52) U.S. Cl. ..... 264/40.1; 264/39; 264/261; 264/277; 264/279; 264/333; 425/123; 425/135; 425/555; 73/803; 249/96

(58) Field of Search ..... 264/40.1, 261, 264/277, 279, 333, 39, 219; 425/123, 135, 96, 555; 249/96; 73/803

(56) References Cited

U.S. PATENT DOCUMENTS 4,491,017 A * 1/1985 Iyer ..... 73/432
4,742,591 A * 5/1988 Muller ..... 14/1
4,772,439 A * 9/1988 Trevino-Gonzalez ..... 264/40.6
5,074,095 A * 12/1991 Wilnau ..... 52/745
5,268,137 A * 12/1993 Scott et al. ..... 264/225
5,487,307 A * 1/1996 Landgren et al. ..... 73/803
5,884,442 A * 3/1999 Breault ..... 52/245
5,900,180 A * 5/1999 Scott et al. ..... 249/61

FOREIGN PATENT DOCUMENTS

JP 3-147806 A * 6/1991 ..... B28B/3/20
JP 4-320804 A * 11/1992 ..... B28B/1/14
JP 4-339603 A * 11/1992 ..... B28B/1/14

* cited by examiner

*Primary Examiner*—Jan H. Silbaugh
*Assistant Examiner*—Michael I. Poe
(74) *Attorney, Agent, or Firm*—Oliff & Berridge, PLC

(57) ABSTRACT

To prevent a skid panel attached with wear resistance material of porcelain tiles or the like on its surface from warping in a longitudinal direction of laying the skid panel, a warp amount of a skid panel is predictively calculated from shrinkage strain, shrinkage force and upper and lower edge stresses of concrete, reverse camber is provided in the longitudinal direction of a mold of the skid panel with tensioning devices to nullify the final warp amount and concrete is fed to the mold to thereby fabricate the panel.

1 Claim, 12 Drawing Sheets

METHOD OF PREVENTING WARP OF A SKID PANEL

BACKGROUND OF THE INVENTION

1. Field of the Invention

The present invention relates to a method and an apparatus of preventing warp of a skid panel.

2. Description of the Related Art

A skid panel is a precast pavement plate attached with a lot of wear resistance material pieces of porcelain tiles, basalt tiles or the like on its surface. It is used as a floor plate laid on a road face of a test course or the like for a braking test of an automobile. According to such a skid panel, there must be no warp or distortion in a longitudinal direction of laying the panel.

A skid panel is fabricated by alignedly laying porcelain tiles on a bottom face in a mold and feeding concrete into the mold and integrating the porcelain tiles with the concrete. According to such a skid panel, in feeding and curing the concrete, the concrete shrinks and in the meantime, the porcelain tiles do not shrink and therefore, the skid panel is warped such that a face thereof almost covered with many tile pieces constitutes a protruded face. The warp is harmful to the braking test and accordingly, an amount of the warp needs to be nullified. Conventionally, there has been no universal technology to minimize the warp amount of such a skid panel. In order to reduce the warp of the skid panels, skilled persons in the art have been tried to find adequate proportioning of concrete materials, proper dimensions of a panel, a shape and dimensions of a mold and a method of appropriate concrete curing by their experiences and perceptions.

SUMMARY OF THE INVENTION

The invention has been carried out in view of the above-described circumstances in which actual warp amounts and calculated warp amounts under respective fabrication conditions of skid panels, are verified, based on which a method and an apparatus of preventing warp of a skid panel having high reproducibility has been developed. It is an object of the invention to provide a method and an apparatus of preventing warp of a skid panel.

The invention has been carried out in order to achieve the above-described object and according to an aspect of the invention, there is provided a method of preventing warp of a skid panel, comprising:

calculating predictively a warp amount of a skid panel from a shrinkage strain, a shrinkage force and upper and lower edge stresses of concrete, deforming a mold of the skid panel with a reverse camber corresponding to the above calculated warp amount so that the final warp amount after aging is nullified, laying in rows porcelain tiles or basalt tiles on a bottom of the mold, and depositing concrete into the mold to fabricate the skid panel in a shape bent reversely in a longitudinal direction of the skid panel.

In the present invention, a skid panel is fabricated in a shape having a reverse camber in a longitudinal direction of the skid panel such that the warp amount is finally nullified.

According to another aspect of the invention capable of preferably implementing the above-described invented method, there is provided an apparatus of preventing warp of a skid panel, comprising:

a bottom plate having a pattern for aligning tiles on the surface, a side plates surrounding the bottom plate, and a tensioning device for providing a camber in a circular arc shape at a bottom plate of a mold of the skid panel along a longitudinal direction of the mold.

A skid panel is a concrete slab in a flat plate shape having a thickness of 100 through 160 mm, a width of about 2 m and a length of about 6 m and the concrete slab is attached on the upper face with porcelain tiles or basalt tiles having a thickness of about 15 mm. The skid panel is a precast concrete product fabricated by spreading porcelain tiles or basalt tiles in rows on a bottom in a mold and feeding concrete thereon.

DETAILED DESCRIPTION OF THE PREFERRED EMBODIMENTS

An explanation will be given of embodiments according to the invention in reference to the drawings as follows.

Figure 7:
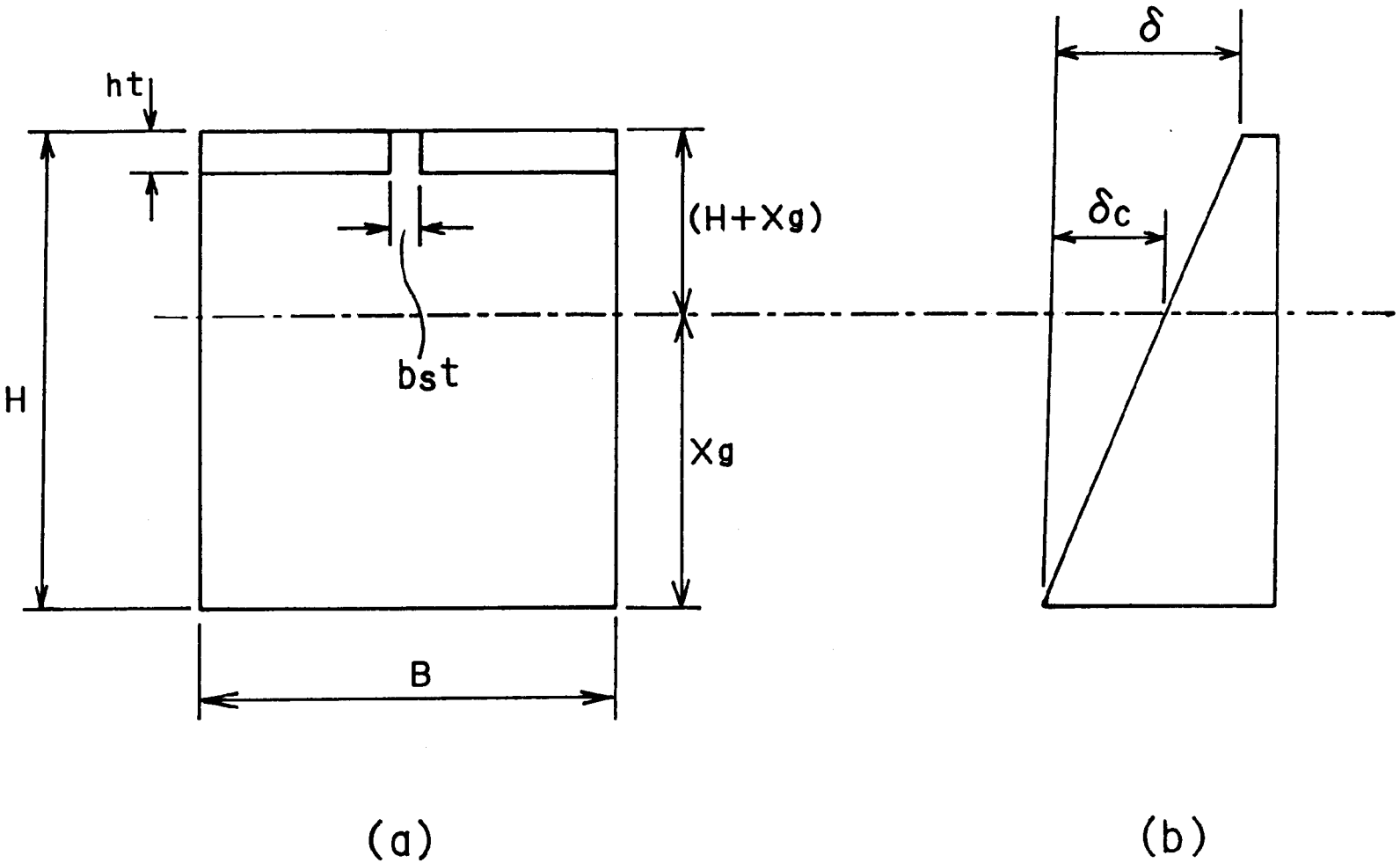
FIG. 7A is a partially sectional view of a skid panel.
FIG. 7B is a diagram showing strain.

First, an explanation will be given of calculating a warp amount of a skid panel. FIG. 7A shows a partial section of a skid panel for calculating a warp amount. FIG. 7B is a diagram showing strain of the section in which a difference of strain between upper and lower edges is designated by notation $\delta$ and strain at the lower edge is designated by notation $\delta c$.

Figure 6:
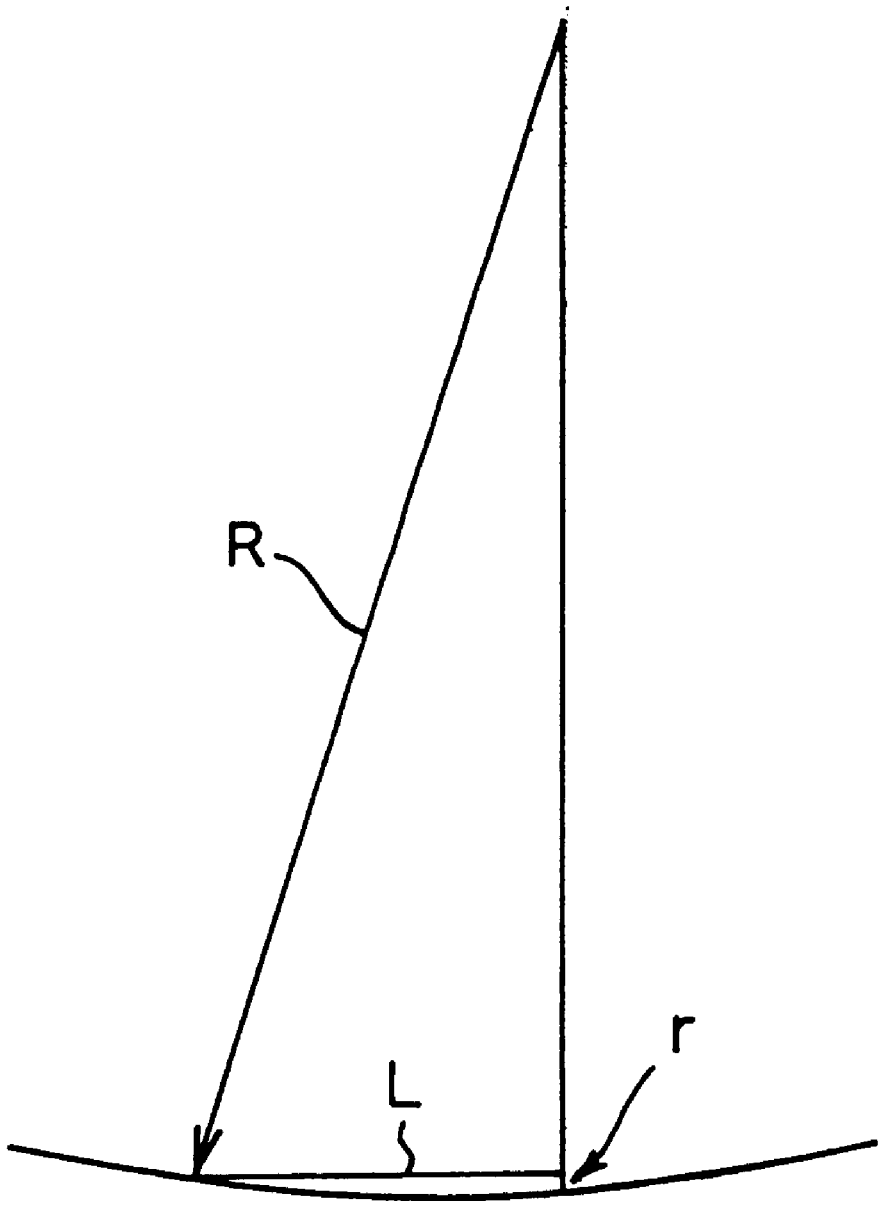
FIG. 6 is an explanatory view of warp of a skid panel.

A total height H of the skid panel is 16 cm, a tile thickness ht is 1.5 cm, a concrete thickness hc is 14.5 cm, a calculation width B is 100 cm and a joint width bst per 1 m of width is 6 cm. Young's modulus Et of tile is 710,000 kg/cm$^2$, Young's modulus Ec of concrete is 140,000 kg/cm$^2$, a ratio of Young's modulus n is 5.07 and an amount of shrinkage of the concrete after curing and drying is 250 $\mu$m/cm in an age of 28 days. As shown in FIG. 6, warp of a skid panel is assumed to be in a shape of a circular arc. An warp amount $\gamma$ is expressed by $\gamma=R-(R^2-L^2)^{1/2}$. In this equation, notation R designates a radius of curvature of warp and notation L designates a half of a length of the skid panel.

Under the above-described conditions, with regard to each of concrete (Co), concrete joint (Cst) and tile (T) of the skid panel, Table 1 shows a sectional area (Ae), a distance from a lower edge (Y), a product thereof (A·Ye), a moment of inertia of area (I), a radius of gyration of area (e) and a moment of inertia of area ($Ae \cdot e^2$) in respect of an neutral axis.

TABLE 1

| | Ae | Y | Y · Ae | I | e | Ae · $e^2$ |
|---|---|---|---|---|---|---|
| Co | 1450 | 7.25 | 10513 | 25405 | −2.66 | 10294 |
| Cst | 9 | 15.25 | 137 | 2 | 5.336 | 256 |
| T | 715 | 15.25 | 10905 | 10905 | 5.336 | 20357 |
| | 2174 | | 21555 | 25541 | | 30907 |

When a position of a neutral axis Xg of a synthesized total section and a synthesized moment of inertia of area Ie are calculated from these values.

Neutral axis Xg=9.91 cm

Ie=56448 $cm^4$

Next, a warp amount is calculated as follows based thereupon.

Operating position of shrinkage force: hc/2=7.25 cm

Shrinkage strain: 0.00025

Shrinkage force: $N=hc \cdot B \cdot Ec \cdot 0.00025=50750$ kg

Distance of eccentricity: $eg=Xg-hc/2=2.66$ cm

Stress at lower edge: $N/Ae+N \cdot eg \cdot yg/Ie=47.09$ $kg/cm^2$

Stress at upper edge: $N/Ae+N \cdot eg \cdot (H-yg)/Ie=8.77$ $kg/cm^2$

Difference btw. stresses at upper and lower edges: 38.3 $kg/cm^2$

Difference btw. strains at upper and lower edges: $\delta=\sigma/Ec=0.0002738$

Strain at lower edge: $\delta c=\delta \cdot yg/H=0.0001696$

Radius of curvature: $R=Xg/\delta c=58444.3$ cm

Warp amount at center in longitudinal direction: $\gamma=R-(R^2-L^2)^{1/2}=0.24$ cm Distance to center in longitudinal direction L: 166 cm The above-described predictive calculation of the warp amount can respectively be calculated in accordance with a kind and dimensions of tiles, a size of a skid panel, conditions of proportioning and curing concrete and other conditions.

Figure 1:
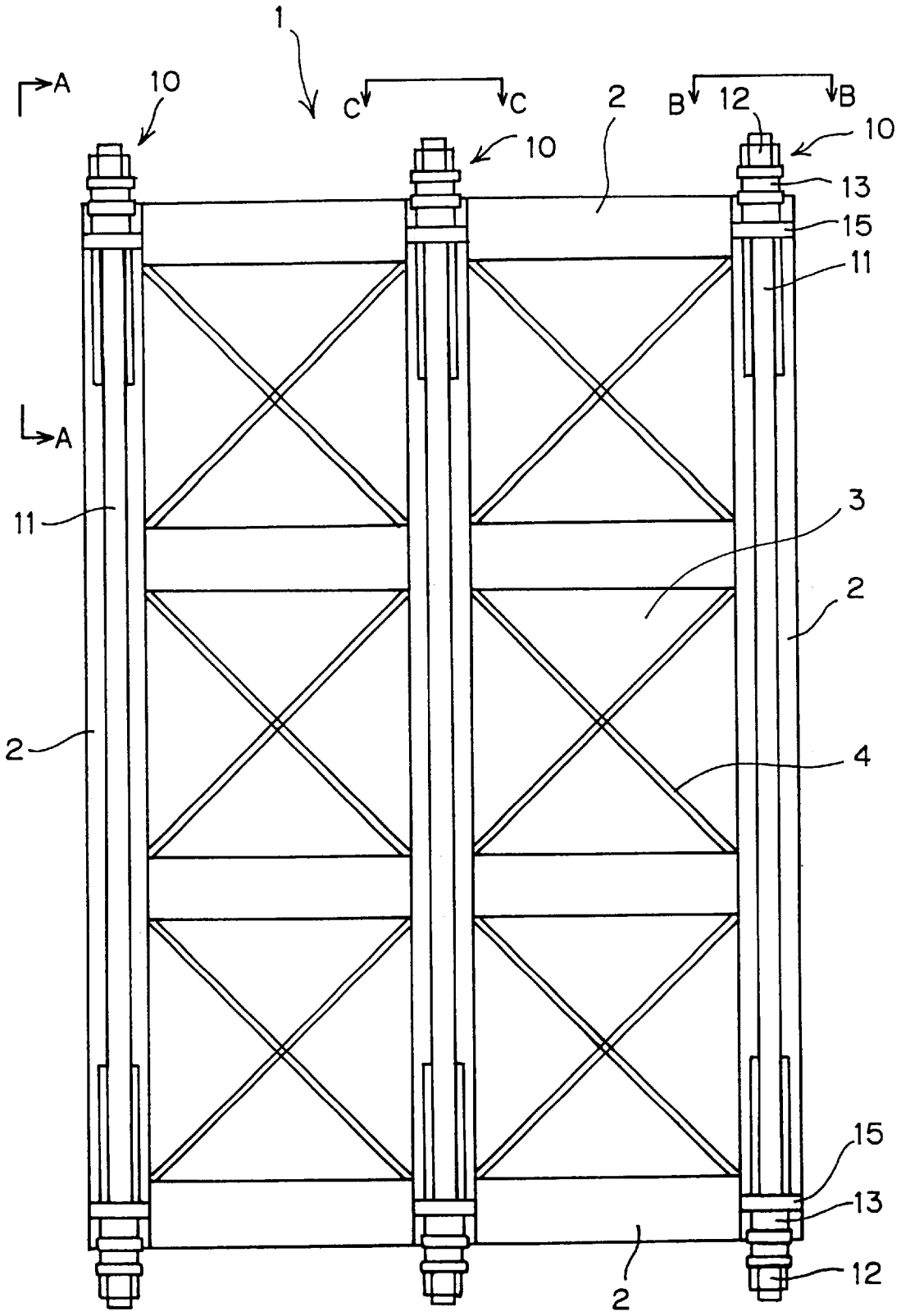
FIG. 1 is a bottom view of a mold for fabricating a skid panel.
Figure 2:
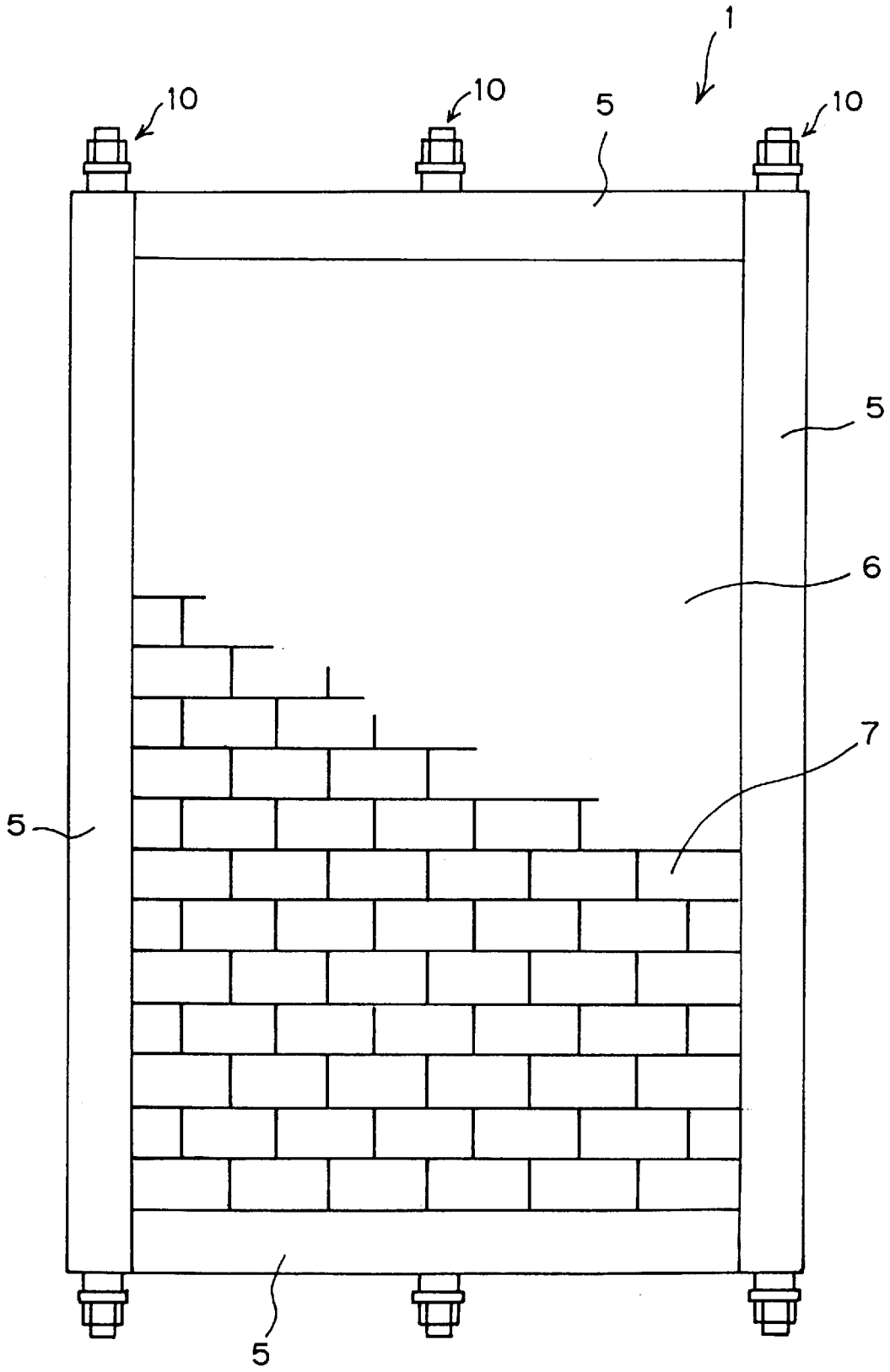
FIG. 2 is a plan view of FIG. 1.
Figure 3:
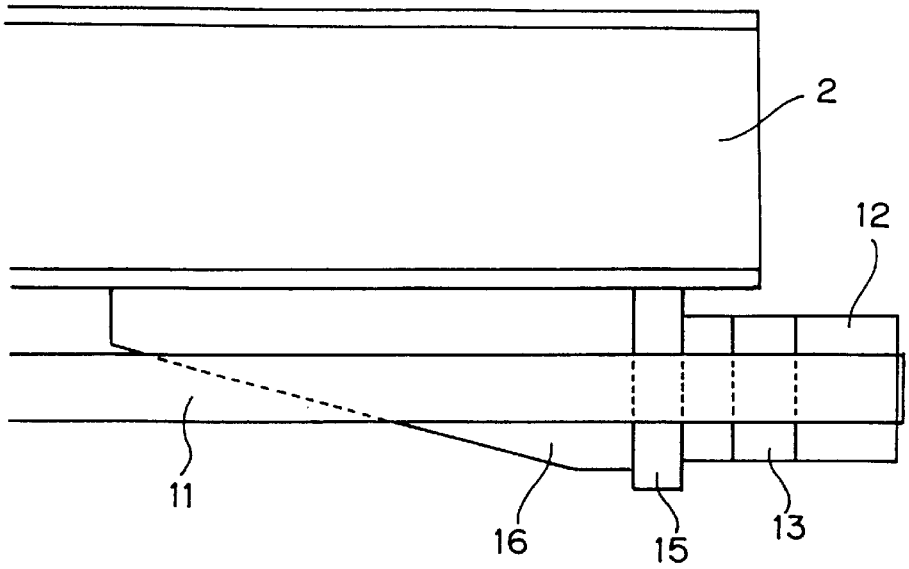
FIG. 3 is a view taken along a line A—A of FIG. 1.
Figure 4:
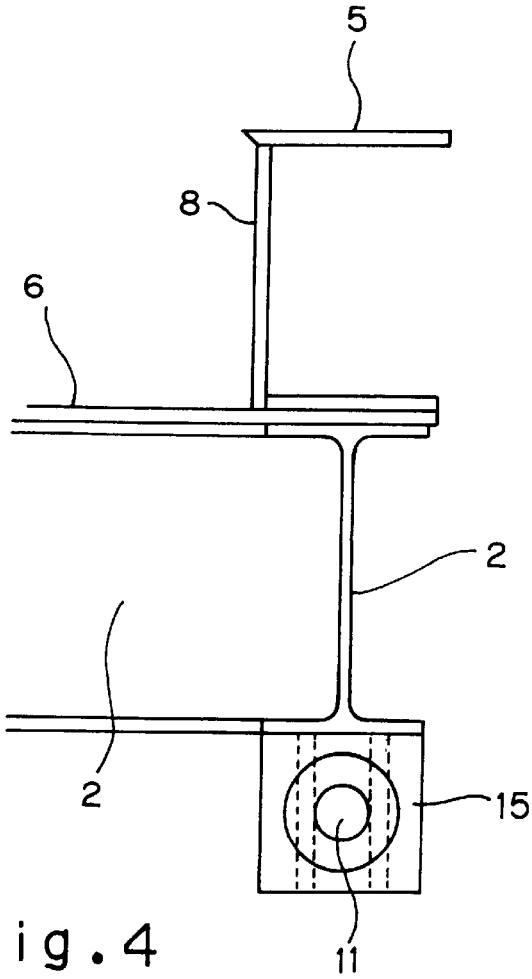
FIG. 4 is a view taken along a line B—B of FIG. 1.
Figure 5:
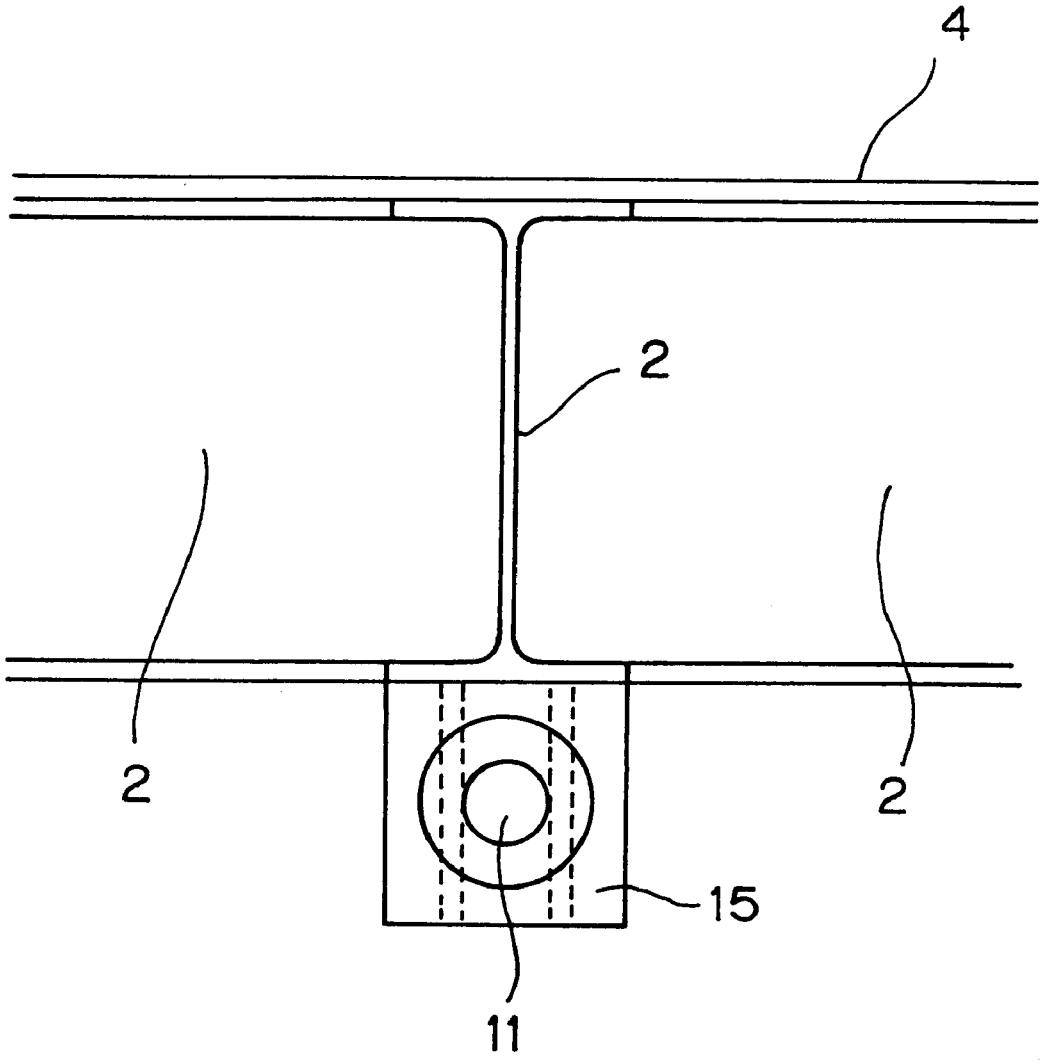
FIG. 5 is a view taken along a line C—C of FIG. 1.

Next, an explanation will be given of an apparatus according to embodiments of the invention. FIG. 1 is a bottom view of a mold 1 for fabricating a skid panel showing an apparatus of the invention. FIG. 2 is a plan view thereof, FIG. 3 is a view taken along a line A—A of FIG. 1, FIG. 4 is a view taken along a line B—B of FIG. 1 and FIG. 5 is a view taken along a line C—C of FIG. 1.

As shown by FIG. 1, receiving frames 2 each comprising I-shaped beam are formed at a lower face of a bottom plate of the mold 1. The receiving frames 2 are arranged longitudinally and transversely at four peripheral portions and middle portions of the bottom plate. Tensioning devices 10 are attached to the receiving frames 2 in the longitudinal direction of the mold. FIG. 2 is a plan view of the mold 1, showing the mold which is surrounded by mold side frames 5 and an upper face of which is opened and a bottom plate 6 is formed with a pattern 7 for laying to align porcelain tiles or basalt tiles. FIG. 3 is a partial view taken along the line A—A of FIG. 1 and is a view showing a situation in which a PC steel rod 11 is locked by a bracket 15 attached to the receiving frame 2. A PC steel rod is essentially a steel rod for concrete prestressing and here is diverted to a tension rod for deforming a mold. The bracket 15 is solidly attached fixedly to the receiving frame 2 with stiffeners 16.

The tensioning device 10 comprises the PC steel rod 11 having tensioning nuts 12 at its both ends. The PC steel rod 11 is engaged with the brackets 15 installed at both ends in the longitudinal direction of the receiving frame 2. The PC steel rod is tightly tensioned by fastening the tensioning nuts 12. The nuts are provided with thrust ball-seats 13. The brackets 15 are fixed to bottom flanges of the I-shaped beams constituting the receiving frames 2. When the PC steel rods each supported at the both ends with the brackets 15 are tensioned, a bending force providing a camber in the longitudinal direction is produced in the I-shaped beam of the receiving frame 2. An amount of bending the receiving frame 2 by the bending force is a value determined by dimensions and shapes of the receiving frames 2 and the side frames 5 of the mold, arrangement of the PC steel rods 11 and tensioning forces provided to the PC rods 11. FIG. 4 is a view taken along a line B—B of FIG. 1 and the PC steel rod 11 bends the receiving frame 2 comprising I-shaped beam, the side frame 5 and a side plate 8 by providing bending force thereto. For example, as fastening the nuts 12 by predetermined torque using a torque wrench, a desired camber in the longitudinal direction can be provided to the mold 1. The nuts may be fixed after tensioning of the PC rods by using a jack tensioning mechanism or the like, in place of fastening the nuts themselves directing with a torque wrench.

EXAMPLES

Skid panels each having a length of 3320 mm, a width of 2000 mm and a thickness of 160 mm or 100 mm attached with porcelain tiles having a thickness of 16 mm on surfaces thereof are prepared. Also skid panels each having a length of 3320 mm, a width of 1914 mm and a thickness of 180 mm or 135 mm attached with basalt tiles having a thickness of 16 mm on surfaces thereof are prepared. In the embodiments, cambers are given to the fabricating molds. In the comparative examples, no cambers are given to the fabricating molds. Predicted warp amounts are calculated and the actual warp amounts are measured with regard to the embodiments and the comparative examples. In the embodiments, uplift cambers corresponding to the calculated warp amounts are provided to the mold frames. A result obtained is shown in Table 2. The effectiveness of the invention is verified from Table 2 since calculated values of warp, uplift amounts and predicted values of warp (difference between the calculated values of warp and the uplift amounts) are approximated with high accuracy to actually measured values of warp and an achieved amounts of warp (uplift amounts+actually measured values of warp respectively).

TABLE 2

| | Kind | Dimensions (mm) | (1) Calculated warp value (mm) | (2) Uplift amount (mm) | (3) = (1) − (2) Predicted measurement value of warp (mm) | (4) Measured value (mm) | Age (day) | (5) = (2) + (4) Warp amount (mm) | (5)/(1) Ratio to calculated value |
|---|---|---|---|---|---|---|---|---|---|
| No. 1 | Porcelain tile | 3320 × 2000 × 160 | 2.4 | 0 | 2.4 | 2.22 | 62 | 2.22 | 0.925 |
| No. 2 | Porcelain tile | 3320 × 2000 × 160 | 2.4 | 1.7 | 0.7 | 0.23 | 60 | 1.93 | 0.804 |

TABLE 2-continued

| | Kind | Dimensions (mm) | (1) Calculated warp value (mm) | (2) Uplift amount (mm) | (3) = (1) − (2) Predicted measurement value of warp (mm) | (4) Measured value (mm) | Age (day) | (5) = (2) + (4) Warp amount (mm) | (5)/(1) Ratio to calculated value |
|---|---|---|---|---|---|---|---|---|---|
| No. 3 | Porcelain tile | 3320 × 2000 × 100 | 4.5 | 0 | 4.5 | 4.57 | 63 | 4.57 | 1.016 |
| No. 4 | Porcelain tile | 3320 × 2000 × 100 | 4.5 | 3.2 | 1.3 | 1.10 | 61 | 4.30 | 0.956 |
| No. 5 | Basalt | 3320 × 1914 × 180 | 2.9 | 0 | 2.9 | 2.70 | 62 | 2.70 | 0.931 |
| No. 6 | Basalt | 3320 × 1914 × 180 | 2.9 | 2.1 | 0.8 | 0.07 | 60 | 2.17 | 0.748 |
| No. 7 | Basalt | 3320 × 1914 × 135 | 3.8 | 0 | 3.8 | 4.15 | 63 | 4.15 | 1.092 |
| No. 8 | Basalt | 3320 × 1914 × 135 | 3.8 | 3.6 | 0.2 | 0.87 | 61 | 4.47 | 1.176 |

Figure 8:
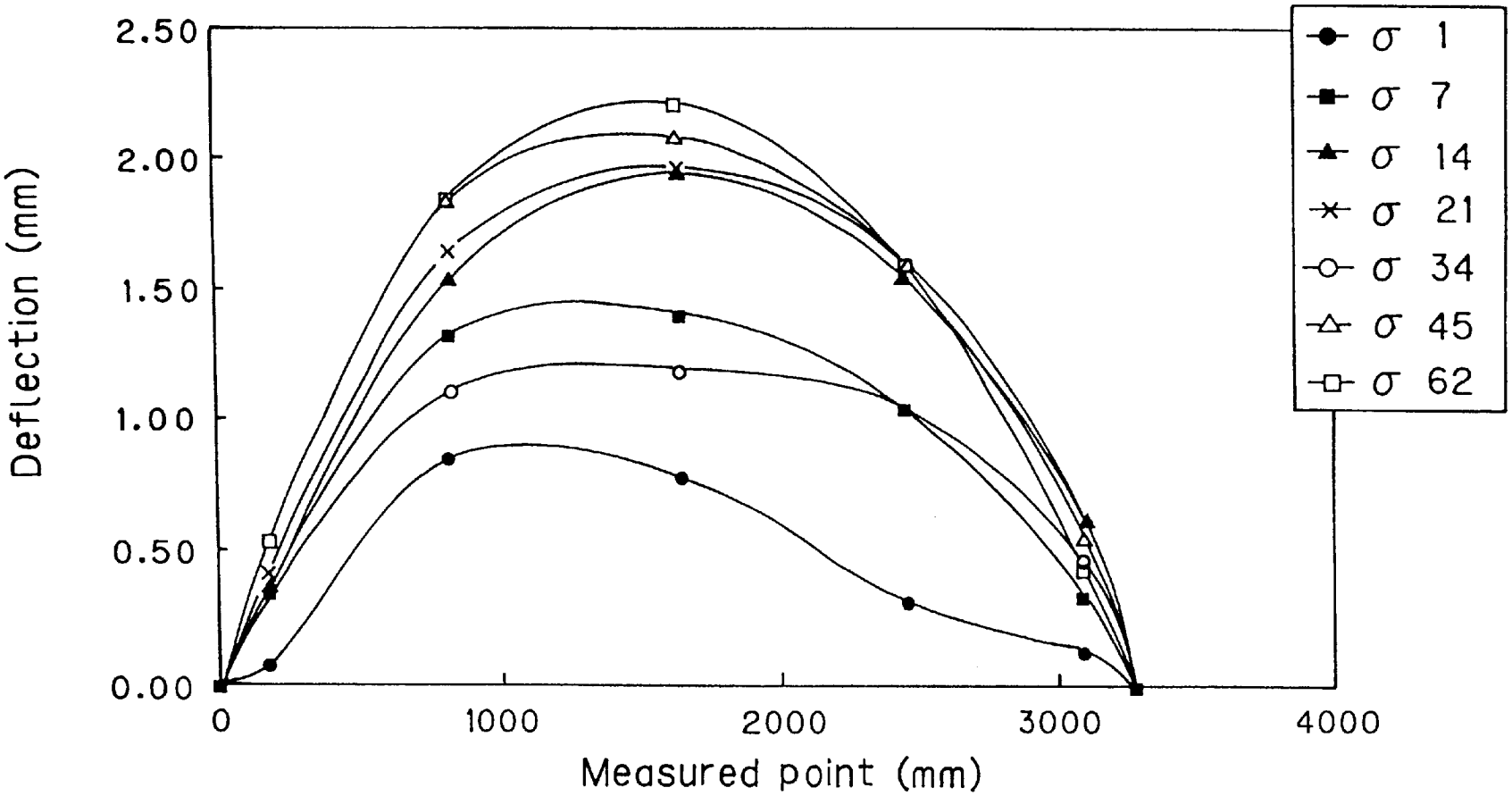
FIG. 8 is a graph showing elapsing change of deflection along the span of a conventional skid panel.
Figure 9:
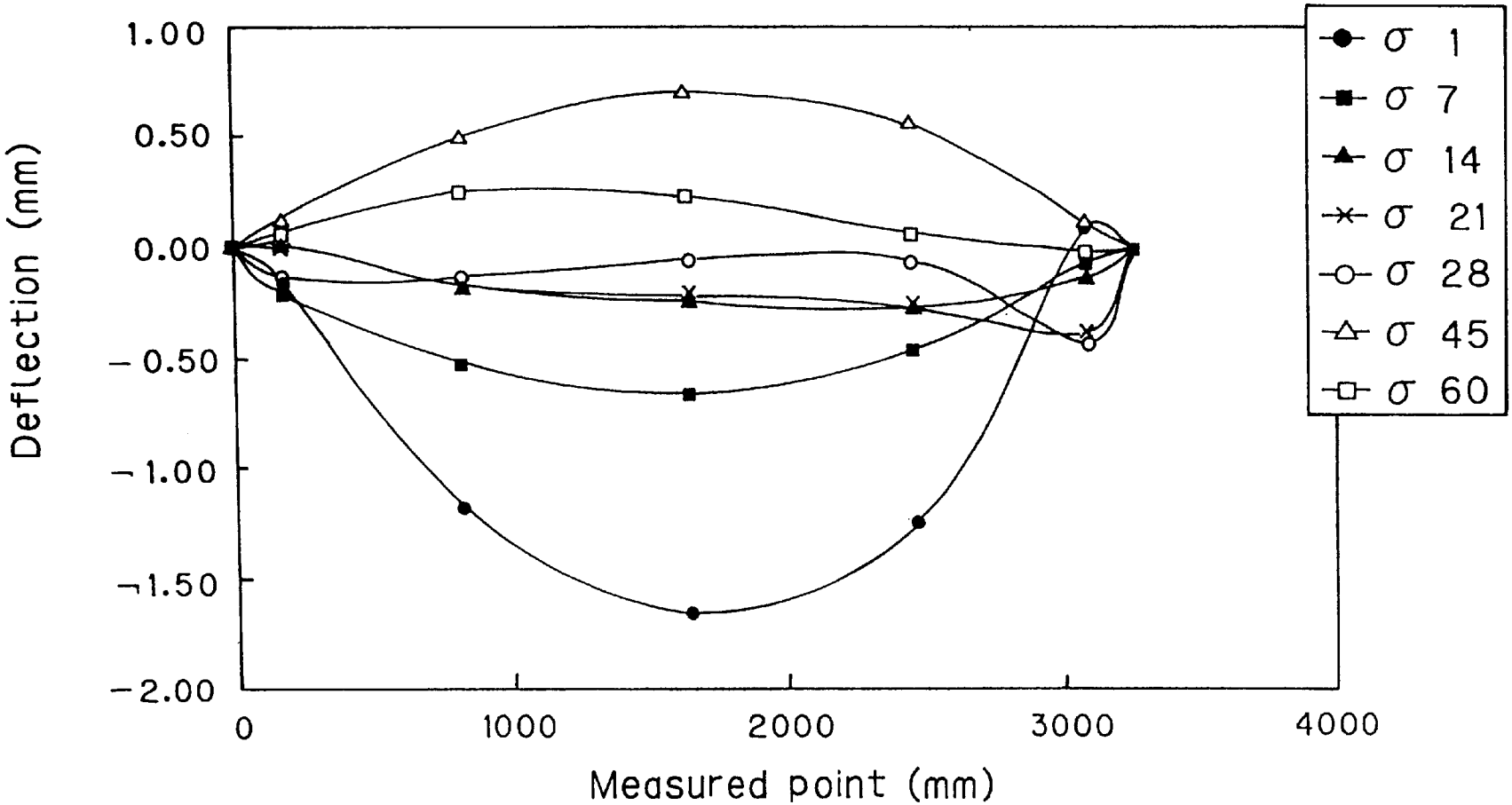
FIG. 9 is a graph showing elapsing change of deflection along the span of a skid panel according to an embodiment.

FIGS. 8 through 13 show graphs of the examples. FIG. 8 corresponds to No. 1 of Table 2 and illustrates graphs showing an elapsing change of the deflection of a skid panel in which an uplift amount is not provided to the skid panel having a length of 3320 mm, a width of 2000 mm and a thickness of 160 mm attached with porcelain tiles having a thickness of 16 mm on the surface. In the drawing, notations σ1 through σ62 designate deflection in correspondence with numbers of elapsed days of 1 through 62 days. Although an initial deflection has been 0.8 mm, the deflection has been 2.22 mm on a final day (σ62) at which 62 days has been elapsed. FIG. 9 corresponds to No. 2 of Table 2 and shows a case in which an uplift amount of 1.7 mm is initially provided at a central portion on the skid panel as shown in FIG. 8. According to the skid panel, the deflection has been reduced successively on 7-th day, 14-th day, 21-st day and has been minimized on 28-th day, successively, reverse strain is caused on 45-th day and the deflection becomes a small value (0.23 mm) on 60-th day.

Figure 10:
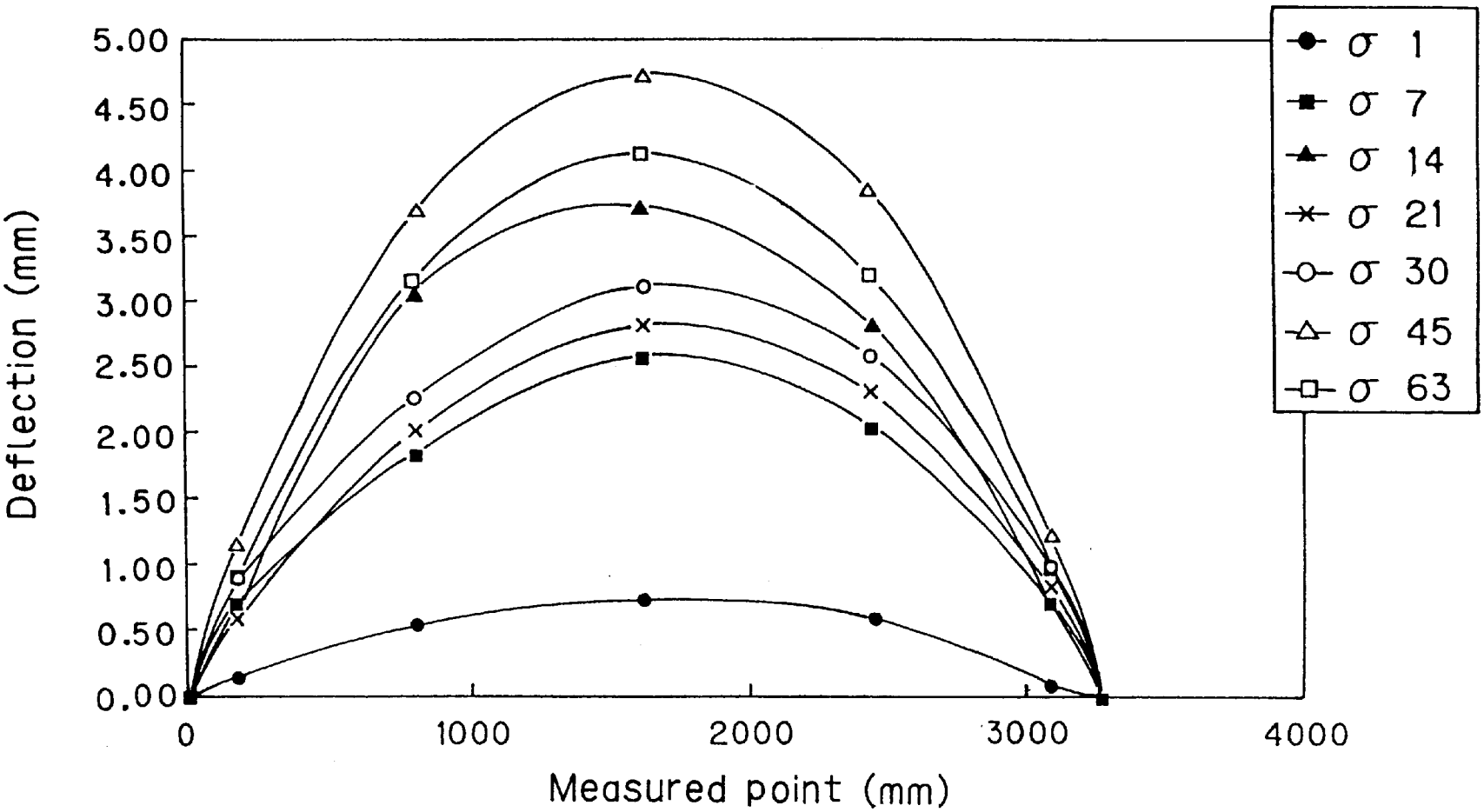
FIG. 10 is a graph showing elapsing change of deflection along the span of a conventional skid panel.
Figure 11:
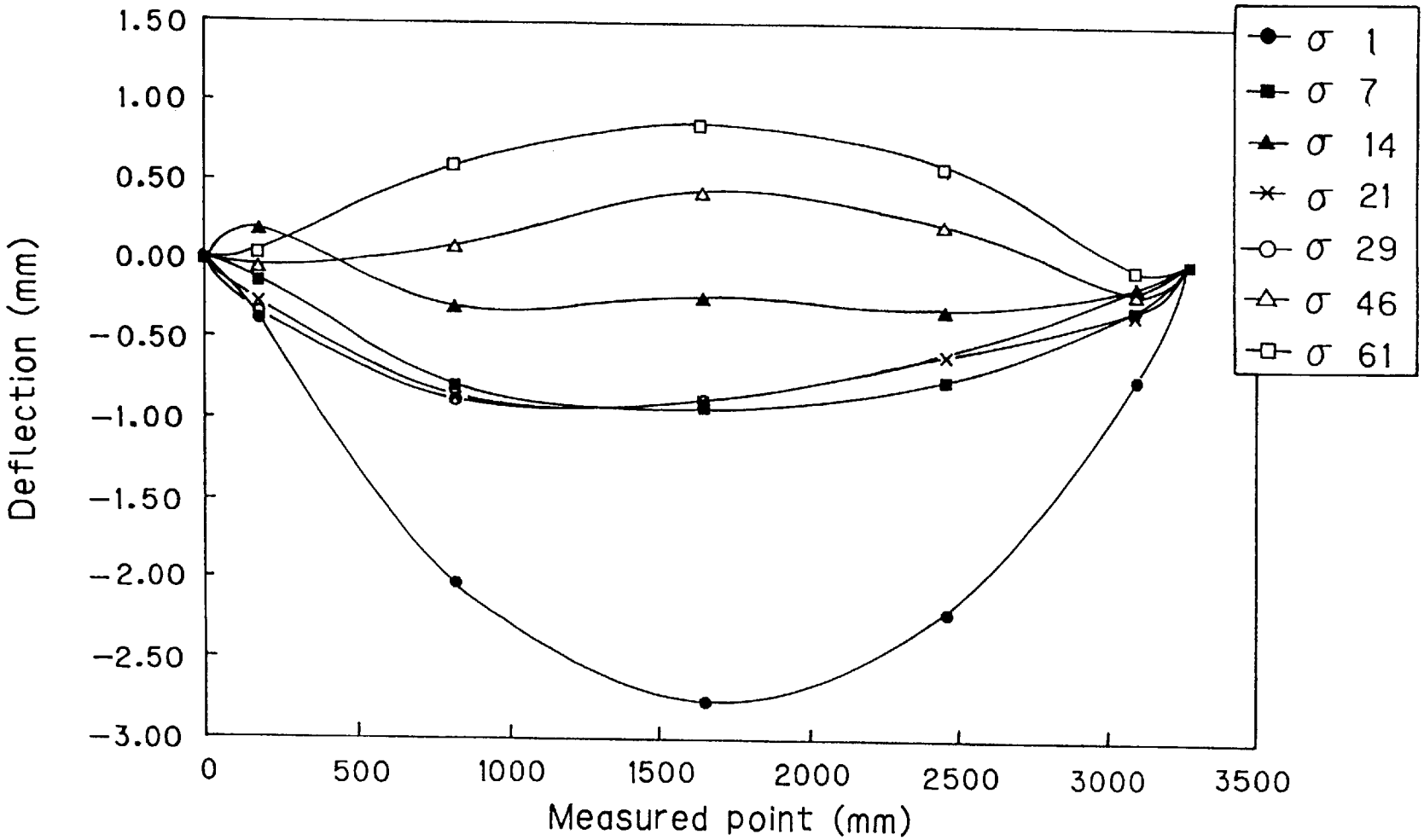
FIG. 11 is a graph showing elapsing change of deflection along the span of a skid panel according to an embodiment.

FIG. 10 shows No. 7 of Table 2 and illustrates graphs showing an elapsing change of the deflection of a skid panel in which an uplift amount is not provided to the skid panel having a length of 3320 mm, a width of 1914 mm and a thickness of 135 mm attached with basalt tiles having a thickness of 16 mm on the surface. Initially, the deflection has been 0.7 mm and after elapse of 63 days, the deflection has been 4.15 mm. FIG. 11 shows a case in which an uplift amount of 3.6 mm is provided to a skid panel having a specification the same as that in FIG. 10. The deflection on 61-st day has been 0.87 mm.

Figure 12:
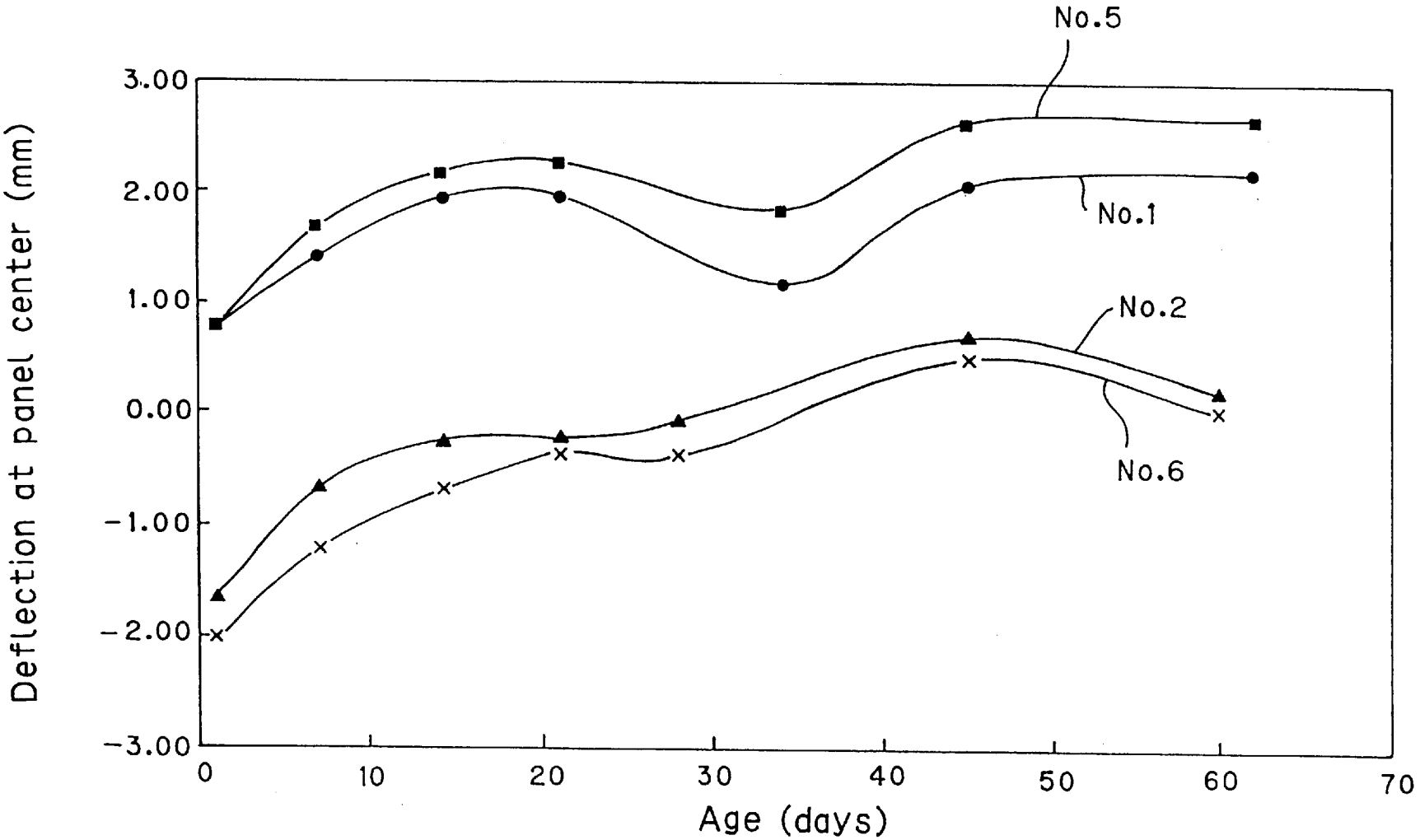
FIG. 12 is a chart showing elapsing change of central deflection of skid panels.
Figure 13:
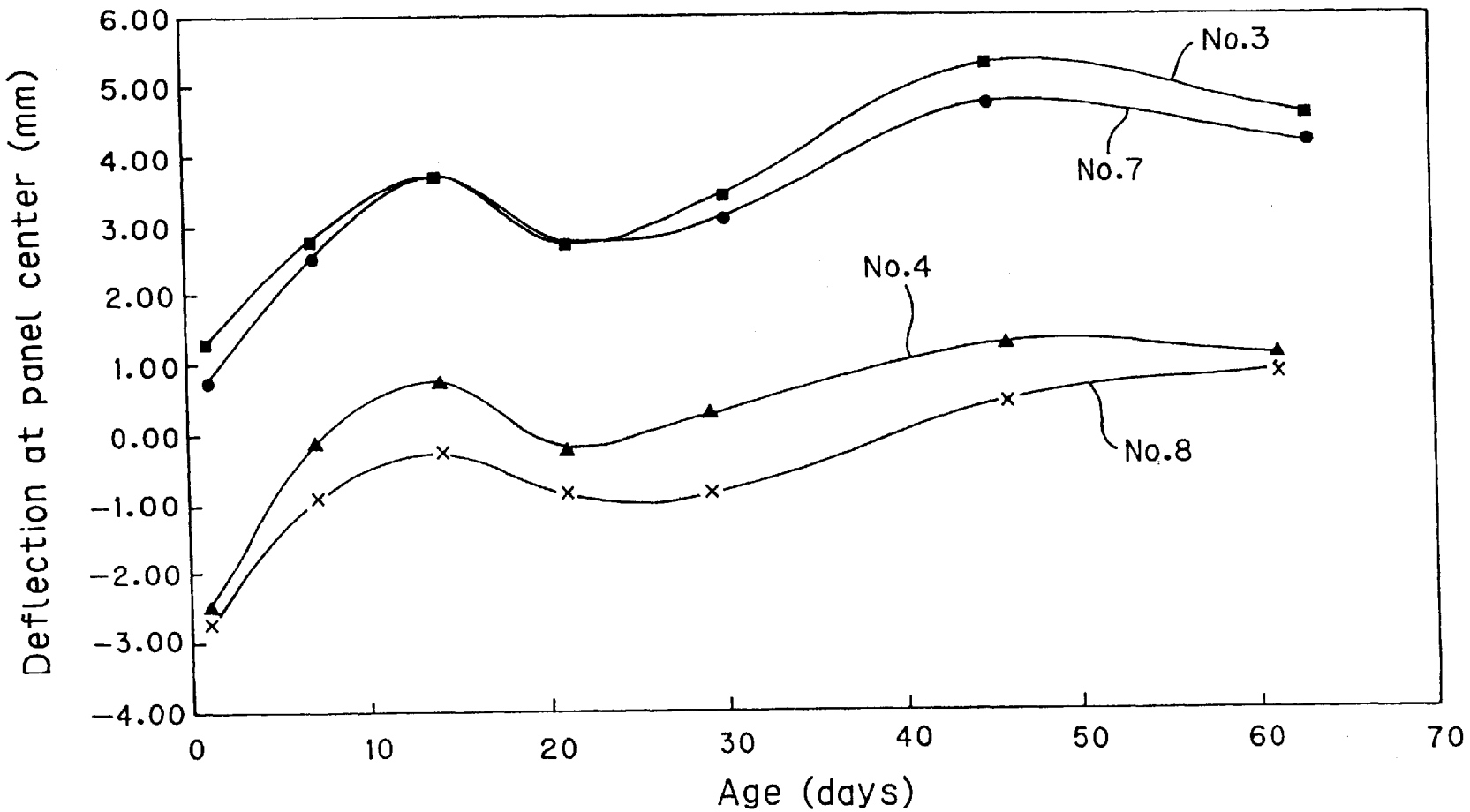
FIG. 13 is a chart showing elapsing change of central deflection of skid panels.

FIGS. 12 and 13 show elapsing changes of the deflection at central portions of No. 1 through 8 skid panels shown by Table 2. As shown by corresponding Nos. described in the drawings, the effect of the invention is apparent when the elapsing changes provided with uplift amounts are compared with the elapsing change which are not provided with the uplift amounts.

According to the invention, a warp amount in the longitudinal direction of a skid panel can be restrained to a minimum and a skid panel having almost no warp can be realized.

What is claimed is:

1. A method of preventing warp of a skid panel comprising the steps of;

calculating predictively a warp amount of a skid panel from a shrinkage strain, a shrinkage force and upper and lower edge stresses of concrete, deforming a mold of the skid panel with a reverse camber corresponding to the above calculated warp amount so that the final warp amount after aging is nullified, laying in rows porcelain tiles or basalt tiles on a bottom of the mold, and depositing concrete into the mold to fabricate the skid panel in a shape bent reversely in a longitudinal direction of the skid panel.

* * * * *